US005898416A

United States Patent [19]

Kuijk et al.

[11] Patent Number: 5,898,416

[45] Date of Patent: Apr. 27, 1999

[54] DISPLAY DEVICE

[75] Inventors: Karel E. Kuijk; Gerrit Oversluizen, both of Eindhoven, Netherlands

[73] Assignee: U.S. Philips Corporation, New York, N.Y.

[21] Appl. No.: 08/812,221

[22] Filed: Mar. 6, 1997

[30] Foreign Application Priority Data

Mar. 18, 1996 [EP] European Pat. Off. ..... 96200744

[51] Int. Cl.[6] ..... G09G 3/36

[52] U.S. Cl. ..... 345/90; 345/91; 349/50

[58] Field of Search ..... 345/90, 91; 349/49–53

[56] References Cited

U.S. PATENT DOCUMENTS

| | | | |
|---|---|---|---|
| 4,731,610 | 3/1988 | Baron et al. | 345/91 |
| 4,997,788 | 3/1991 | Martens et al. | 437/175 |
| 5,151,691 | 9/1992 | Kuijk | 345/91 |
| 5,666,133 | 9/1997 | Matsuo et al. | 345/100 |

*Primary Examiner*—Mark K. Zimmerman
*Assistant Examiner*—Vincent E. Kovalick
*Attorney, Agent, or Firm*—F. Brice Faller

[57] ABSTRACT

A display device which is based on a number of pixels (2) which are arranged in rows and columns, each pixel having a two-pole switching element (3) between an electrode (13) of a pixel and a row electrode (5), and a second two-pole switching element (23) between said electrode of the pixel and an auxiliary row electrode (25) used for resetting, auxiliary row electrodes for resetting having a common connection (24) for a plurality of rows of pixels.

4 Claims, 3 Drawing Sheets

DISPLAY DEVICE

BACKGROUND OF THE INVENTION

The invention relates to a display device comprising an electro-optical medium between a first supporting plate and a second supporting plate, which display device is provided with row electrodes on the first supporting plate and column electrodes on the second supporting plate. A number of pixels which are arranged in rows and columns, a pixel being defined by picture electrodes on surfaces of the supporting plates facing each other, the picture electrode on the first supporting plate being coupled to a row electrode via a first, non-linear two-pole switching element, and to an auxiliary row electrode.

Such a display device can suitably be used, for example, to display alpha-numerical information and to display video information by means of passive electro-optical media such as liquid crystals, electrophoretic materials and electrochromic materials.

A display device of the type mentioned in the opening paragraph is described in U.S. Pat. No. 5,151,691. Means for charging the pixel, prior to selection, to a voltage at the boundary of or beyond the range for picture display (also referred to as "resetting") are provided, comprising a distributed capacitance between the row electrode and the common electrode for each row of pixels. In addition, each common electrode is connected to a reference voltage via an additional diode to periodically recharge the capacitance. Particularly in display devices having relatively large dimensions, the charge stored in said capacitance for resetting must be large enough to supply the current necessary for resetting. Besides, as described in said Patent Specification, the voltage drop across the pixel as a result of switching effects must be minimized. To this end, the width of the row electrode in U.S. Pat. No. 5,151,691 is approximately 1/15 of the height of a pixel. This is at the expense of the aperture (effective viewing area).

In addition, the provision of the capacitance requires additional process steps, while recharging the capacitances requires an additional diode for each row of pixels.

OBJECTS AND SUMMARY OF THE INVENTION

It is an object in which at least some of the above problems are largely precluded.

To this end, the auxiliary row electrodes are mutually interconnected in groups of auxilliary row electrodes, each group having a common driving connection.

By providing the common driving connection with a control voltage, row of pixels can be reset without the (distributed) capacitance being required. In addition, the external reset voltage can be chosen to be such that said additional diodes can be dispensed with. Since no (distributed) capacitance is required now, the width of the row electrodes (the dimension of the pixels remaining the same) can be smaller, resulting in a larger aperture. This has the advantage that the brightness increases while the power of an illumination source (of the type customary in this kind of display devices) remains the same, or the same brightness is obtained with less power. This has advantages, in particular, in display devices having a high-power illumination source, particularly if the picture diameters are larger than 40 cm, but also if the picture diameters are larger than, for example, 25 cm, an improvement is obtained.

The number of mutually interconnected auxiliary row electrodes within a group, which are provided with a control voltage via the same common driving connection, can be chosen to be such (for example 10) that the number of additional external connections remains acceptable. Dependent on the accepted error it has a value of 1/50–1/200 of the number of rows.

These and other aspects of the invention will be apparent from and elucidated with reference to the embodiments described hereinafter.

DESCRIPTION OF THE PREFERRED EMBODIMENTS

Figure 1:
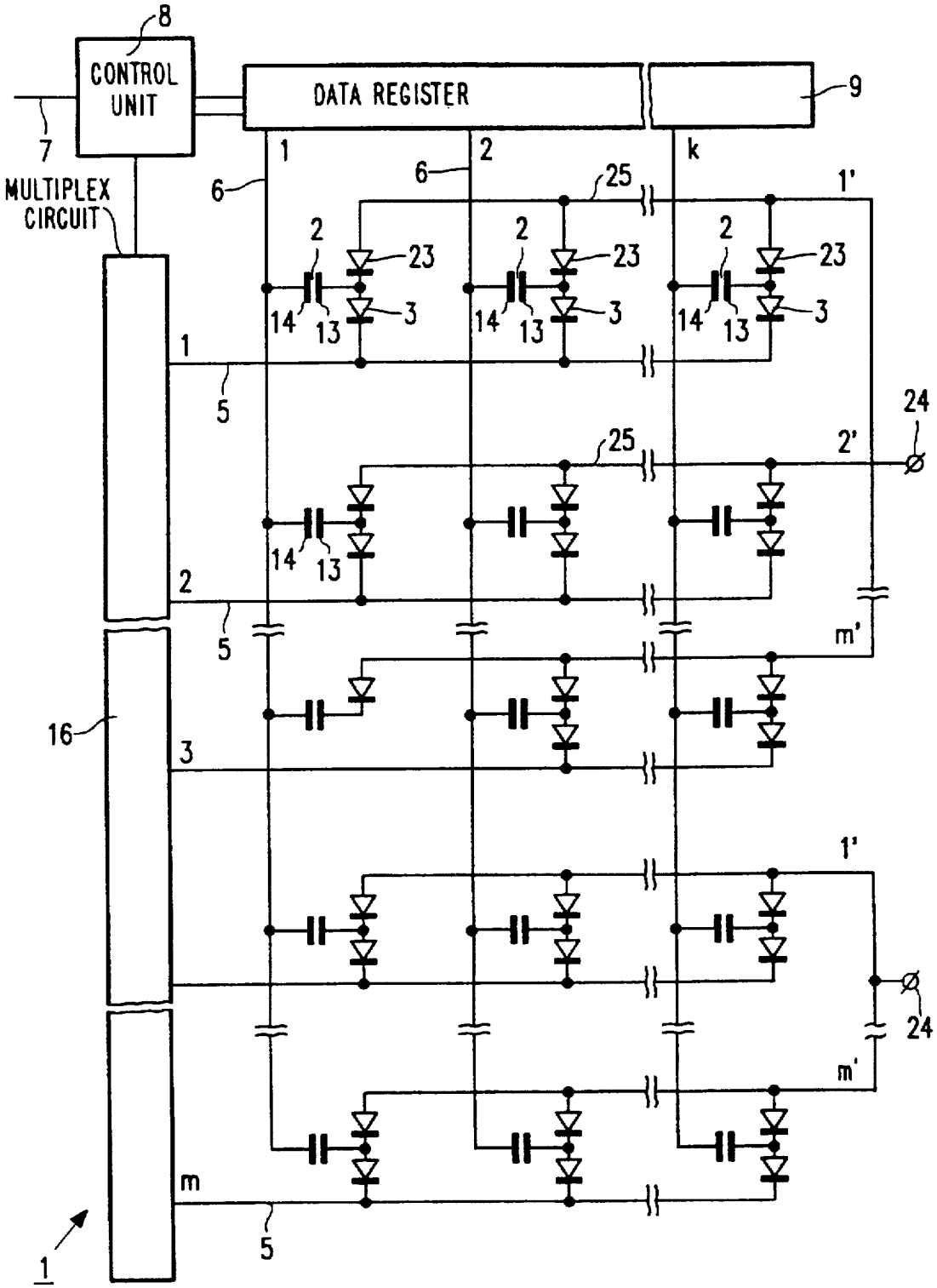
FIG. 1 schematically shows an equivalent circuit diagram of a part of the device in accordance with the invention, and FIG. 2 schematically shows, in section, a part of the device in accordance with the invention.

FIG. 1 schematically shows an electrical equivalent circuit diagram of a part of a display device 1. This device comprises a matrix of pixels 2 which are arranged in m rows and k columns. In this example, the pixels 2 are connected to row electrodes 5 via non-linear, two-pole switching elements, in this example diodes 3. A row of pixels is selected via the row electrodes 5, which select the relevant rows. The row electrodes are successively selected by means of a multiplex circuit 16.

Incoming (video) information 7 is stored in a data register 9, if necessary after having been processed in a processing/control unit 8. The voltages supplied by the data register 9 to column electrodes 6 cover a voltage range which is sufficient to adjust the desired range of grey levels. As a result, during selection, charging of the pixels 2 takes place as a function of the voltage difference between the picture electrodes 13, 14 and the duration of the pulse determining the information. In this example, the picture electrodes 14 form a common column electrode 6. The pixels 2 are further connected to an auxiliary row electrode 25 via non-linear, two-pole switching elements, in this example diodes 23. In accordance with the invention, several electrodes 25 (a block) are mutually interconnected and connected to a common driving connection 24.

Figure 2:
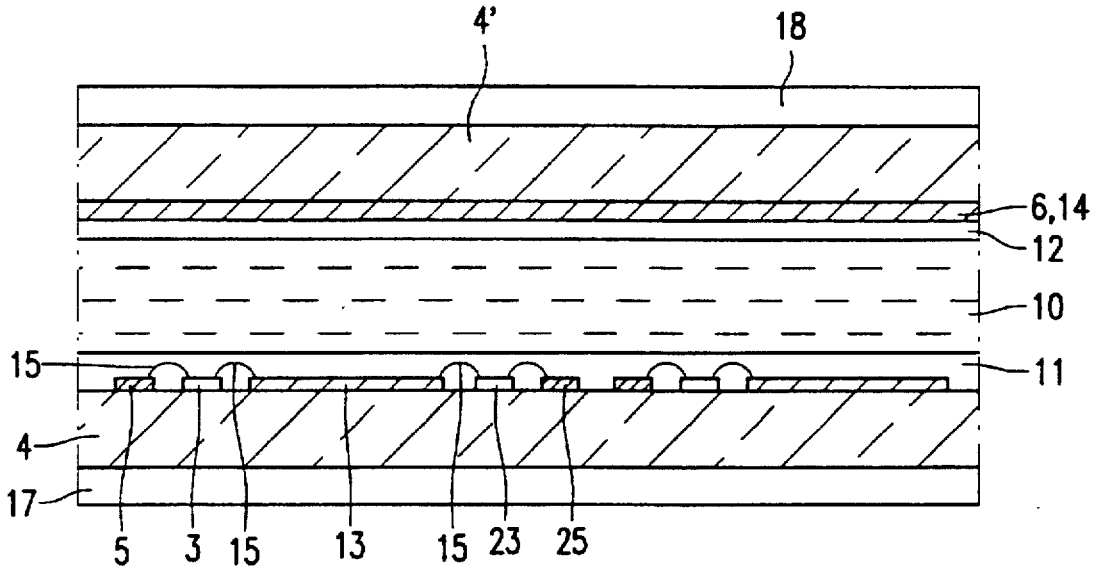

FIG. 2 schematically shows, in cross-section, a part of a liquid-crystal display device 1 in accordance with the invention, which comprises a twisted-nematic liquid-crystal material 10 which is sandwiched between two substrates 4, 4', for example, of glass, which are provided with picture electrodes 13 and 14. Said picture electrodes 13 are connected on the one hand, via diodes 3 and via (schematically drawn) interconnections 15, to row electrodes 5 for supplying selection signals. To supply data signals, the picture electrodes 14 are connected to column electrodes 6 which, in this example, are in the form of common, strip-shaped electrodes.

In accordance with the invention, the picture electrodes 13 on the first supporting plate 2 are connected on the other hand, via diodes 23 and interconnections 15, to (successive) auxiliary row electrodes 25 for supplying reset signals, a number of said electrodes 25 being mutually interconnected. The diodes are in this case made from amorphous silicon and may be, for example, pin diodes or Schottky diodes. Said diodes may be in the form of lateral diodes as described e.g. in U.S. Pat. No. 4,997,788 or ledge-diodes while, in addition, redundancy (for example two diodes arranged in series or in parallel) can be used.

The device further comprises two polarizers 17, 18 having mutually perpendicular directions of polarization. The device also comprises orientation layers 11, 12, which orient the liquid-crystal material at the inner surfaces of the substrate, in this example, in the direction of the polarization axes of the polarizers, so that the cell has a twist angle of 90 degrees. In this case, the liquid-crystal material has a positive optical anisotropy and a positive dielectric anisotropy.

Figures 3, 4, 5, 6:
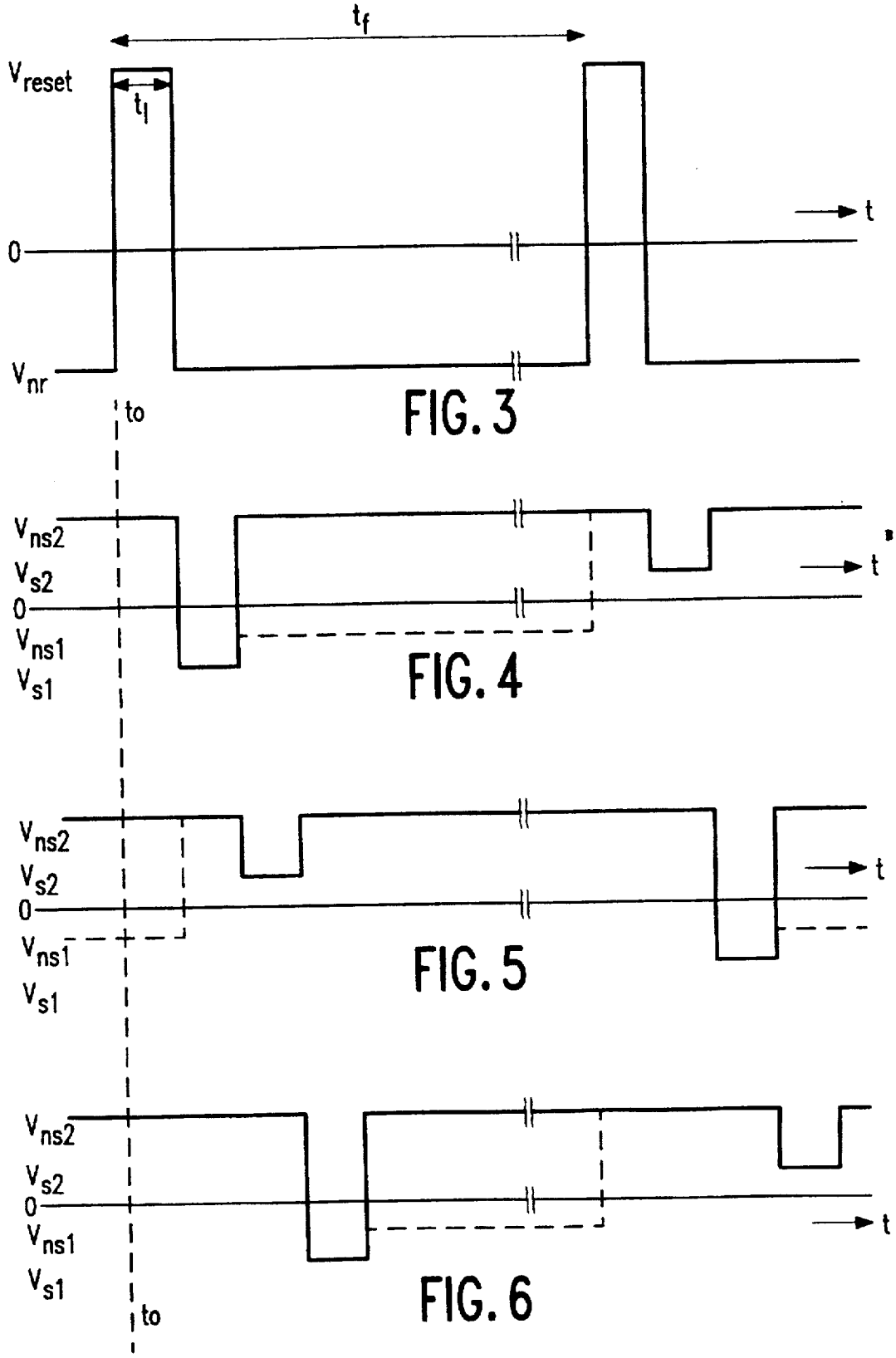
FIGS. 3 to 6 show some control signals for a device in accordance with FIGS. 1 and 2.

FIGS. 3, 4, 5 and 6 show, in succession, the drive signals for resetting (connections 24) and selecting a single block, for example the first block of m' lines. The reset signal $V_{reset}$ has an amplitude which is sufficiently high to charge all pixels in the first m' rows to a voltage at the boundary of the voltage range for picture display or even beyond said range, irrespective of the voltage on the columns. After, for example, a full line period $t_1$, the connection 24 of the relevant block acquires a voltage $V_{nr}$. The first m' rows of pixels are reset again at the beginning of the next picture period (FIG. 3). After resetting, a first row within a block, in this example row 1, is selected during a line period (or a part thereof) via a row electrode 5 by means of a selection voltage $V_{s1}$. After selection, the row electrode acquires a voltage $V_{ns2}$. To counteract degradation as a result of DC voltages across the liquid-crystal material, the device is preferably operated by means of an AC voltage across the pixels. To this end, the data voltages in every subsequent picture period are presented in an inverted manner and, in the next picture period, row 1 is selected by means of a selection voltage $V_{s2}$ (FIG. 4). FIG. 5 shows the selection signal for row 2; this is identical to that of row 1, yet shifted by a picture period plus a line period. The selection signal for row 3 is identical again to that for row 1 (FIG. 6), yet shifted by two line periods. As a result, in successive rows of pixels the voltages across the pixels are presented with reversed sign (row inversion). In FIGS. 4 to 6, dashed lines are used to indicate yet another variation of the selection voltages, with the row electrodes, after selection, first acquiring a non-selection voltage $V_{ns1}$ via the voltage $V_{s1}$; this is the minimum voltage necessary to preclude that the diodes 3 are conducting between the selection periods.

In the above example, m'=10, while, for example, m=1200; it has been found that at such a ratio, at which the pixels of one row are provided with a reset voltage during maximally 1/120 of the picture period, resetting is (substantially) invisible in the picture displayed. In the case of a device having 480 rows (m=480) m'=4 can be chosen for the same reason, while in a device having 1800 rows (m=1800) m'=15 can be chosen. More generally m' can vary between 1/50 m and 1/200 m, depending on the required quality of the picture. For one display several values of m' may be used, e.g. in case different pictures are provided on one screen, while one of the pictures may be displayed with less quality than the other.

After resetting, the rows of pixels within one block are successively provided with the proper pixel voltage. The first row of each block retains this voltage (apart from leakage loss, etc.) during a period which is equal to a frame period minus the reset period (in the above example 1 line period), hence during (m-1) line periods, whereafter this row is selected again and provided with the proper information. The second row of each block retains the pixel voltage for a period equal to a frame period minus the reset period (1 line period) and 1 line period, in all (m-2) line periods, whereafter this row is selected again and provided with the proper information. The tenth row of each block retains the pixel voltage during a period which is equal to a frame period minus the reset period (1 line period) and 9 line periods, in all 10 line periods, whereafter this row is selected again and provided with the proper information.

To preclude that the drive of different rows having a different duration of the proper information becomes visible as a difference in average transmission, the row or column voltage within a block can advantageously be adapted for every subsequent selection of a row within said block, in such a manner that the transmission is adjusted so as to be slightly different. For example, in the case of the above-mentioned division in blocks of 10 rows, the amplitude of the column voltage during writing of the row selected as the second one is changed relative to the column voltage during writing of the row selected as the first row, the column voltage during writing of the row selected as the third one is changed relative to the column voltage during writing of the row selected as the second row, etc.

In summary, the invention provides a display device, which is based on a number of pixels which are arranged in rows and columns, each pixel having a two-pole switching element between an electrode of a pixel and a row electrode, and a second two-pole switching element between said electrode of the pixel and an auxiliary row electrode used for resetting, said auxiliary row electrode for resetting having a mutually common connection for a plurality of rows of pixels.

We claim:

1. A display device comprising an electro-optical medium between a first supporting plate and a second supporting plate, which display device is provided with a number of row electrodes on the first supporting plate and column electrodes on the second supporting plate and with a number of pixels which are arranged in a number of rows and a number of columns, a pixel being defined by picture electrodes on surfaces of the supporting plates facing each other, the picture electrode on the first supporting plate being coupled to a row electrode via a first, non-linear two-pole switching element, and to an auxiliary row electrode via a second, non-linear two-pole switching element, wherein the auxiliary rows are grouped into groups of a number of mutually electrically connected auxiliary electrodes, each group having a common driving connection, and the number of mutually interconnected auxiliary row electrodes within a group has a value of 1/50–1/200 of the number of rows.

2. A display device as claimed in claim 1, wherein substantially all groups have the same number of mutually interconnected auxiliary electrodes.

3. A display device as claimed in claim 1, characterized in that the non-linear, two-pole switching elements are diodes made of amorphous silicon.

4. A display device as claimed in claim 1, characterized in that the non-linear two-pole switching elements are lateral diodes.

* * * * *